US007048807B2

(12) United States Patent
Stoffer et al.

(10) Patent No.: US 7,048,807 B2
(45) Date of Patent: May 23, 2006

(54) CERIUM-BASED SPONTANEOUS COATING PROCESS FOR CORROSION PROTECTION OF ALUMINUM ALLOYS

(75) Inventors: James O. Stoffer, Rolla, MO (US); Thomas J. O'Keefe, Rolla, MO (US); Matthew O'Keefe, Rolla, MO (US); Eric L. Morris, Rolla, MO (US); Scott Hayes, Rolla, MO (US); Paul Yu, Rolla, MO (US); Alex Williams, Rolla, MO (US); Berny F. Rivera Vasquez, Samegua-Moquegua (PE); Xuan Lin, Orange, CT (US)

(73) Assignee: The Curators of the University of Missouri, Columbia, MO (US)

( * ) Notice: Subject to any disclaimer, the term of this patent is extended or adjusted under 35 U.S.C. 154(b) by 195 days.

(21) Appl. No.: 10/214,955

(22) Filed: Aug. 8, 2002

(65) Prior Publication Data

US 2004/0028820 A1 Feb. 12, 2004

(51) Int. Cl.
*C23C 22/07* (2006.01)

(52) U.S. Cl. ..... 148/254; 148/261; 148/273

(58) Field of Classification Search ..... 148/254, 148/261, 273, 276
See application file for complete search history.

(56) References Cited

U.S. PATENT DOCUMENTS

| | | | | |
|---|---|---|---|---|
| 5,192,374 | A * | 3/1993 | Kindler | 148/272 |
| 5,221,371 | A * | 6/1993 | Miller | 148/273 |
| 5,362,335 | A * | 11/1994 | Rungta | 148/272 |
| 5,587,059 | A | 12/1996 | Yamoto et al. | |
| 5,866,652 | A | 2/1999 | Hager et al. | |
| 5,932,083 | A | 8/1999 | Stoffer et al. | |
| 5,964,928 | A | 10/1999 | Tomlinson | |
| 6,139,610 | A | 10/2000 | Sinko | |
| 6,190,780 | B1 | 2/2001 | Shoji et al. | |
| 6,200,672 | B1 | 3/2001 | Tadokoro et al. | |
| 6,248,184 | B1 | 6/2001 | Dull et al. | |
| 6,306,276 | B1 | 10/2001 | Nobe et al. | |
| 6,312,812 | B1 | 11/2001 | Hauser et al. | |
| 6,716,370 | B1 | 4/2004 | Kendig | |
| 2002/0003093 | A1 | 1/2002 | Dull et al. | |
| 2003/0024432 | A1 | 2/2003 | Chung et al. | |
| 2003/0044515 | A1 | 3/2003 | Sandhage | |
| 2003/0221590 | A1 | 12/2003 | Sturgill | |
| 2003/0230363 | A1 | 12/2003 | Sturgill et al. | |
| 2003/0234063 | A1 | 12/2003 | Sturgill et al. | |
| 2004/0005478 | A1 | 1/2004 | Kendig et al. | |
| 2004/0011252 | A1 | 1/2004 | Sturgill et al. | |
| 2004/0016363 | A1 | 1/2004 | Phelps et al. | |
| 2004/0016910 | A1 | 1/2004 | Phelps et al. | |
| 2004/0020568 | A1 | 2/2004 | Phelps et al. | |
| 2004/0026260 | A1 | 2/2004 | Stoffer et al. | |
| 2004/0026261 | A1 | 2/2004 | Stoffer et al. | |
| 2004/0104377 | A1 | 6/2004 | Phelps et al. | |
| 2004/0175587 | A1 | 9/2004 | Kendig | |
| 2004/0186201 | A1 | 9/2004 | Stoffer et al. | |
| 2004/0249023 | A1 | 12/2004 | Stoffer et al. | |
| 2004/0249043 | A1 | 12/2004 | Stoffer et al. | |

FOREIGN PATENT DOCUMENTS

| | | |
|---|---|---|
| JP | 55/065326 A | 5/1980 |
| WO | WO 88/06639 | 9/1988 |
| WO | WO 02/14586 A1 | 2/2002 |

OTHER PUBLICATIONS

Aldykiewicz, Jr., et al., Studies of the Formation of Cerium Rich Protective Films Using X-Ray Absorption Near-Edge Spectroscopy and Rotating Disk Electrode Methods, J. Electrochem, Soc., vol. 143, No. 1, Jan. 1996, pp. 147-153.

Hinton, et al., Cerium Conversion Coatings for the Corrosion Protection of Aluminum, Materials Forum, vol. 9, No. 3, 1986, pp. 162-173.

Hinton, et al., Cerium Oxide Coatings for Corrosion Protection of Aluminum Alloys, Materials Australasia, Jan./Feb., 1987, pp. 18-20.

Aldykewicz, Jr., et al., The Investigation of Cerium as a Cathodic Inhibitor for Aluminum-Copper Alloys, J. Electrochem Soc., vol. 142, No. 10, Oct. 1995, pp. 3342-3350.

Davenport, et al., Xanes Investigation of the Role of Cerium Compounds as Corrosion Inhibitors for Aluminum, Corrosion Science, vol. 32, No. 5/6, p. 653-663, 1991.

(Continued)

*Primary Examiner*—George Wyszomierski
(74) *Attorney, Agent, or Firm*—Senniger Powers

(57) ABSTRACT

A cerium-based coating for corrosion resistance is applied by exposing a cleaned aluminum-based component to a corrosion-inhibiting cerium solution containing cerium ions in the presence of an oxidizing agent. The coating deposits spontaneously without an external source of electrons.

55 Claims, No Drawings

OTHER PUBLICATIONS

Weiser, The Hydrous Oxides, McGraw-Hill Book Company, Inc., 1926, pp. 253-259.
Hinton, et al., The Inhibition of Aluminium Alloys Corrosion by Cerous Cations, Metals Forum, vol. 7, No. 4, 1984, pp. 211-217.
Mansfeld et al., Corrosion Protection of Al Alloys and Al based Metal Matrix, Corrosion 88, Mar. 21-25, 1988 paper 380, NACE.
Davenport et al., X-Ray Absorption Study of Cerium in the Passive Film on Aluminum, J. Electrochem Soc., vol. 136, No. 6, Jun. 1989, pp. 1837-1838.
Hinton, New Approaches to Corrosion Inhibition with Rare Earth Metal Salts, Corrosion 89, Apr. 17-21, 1989, paper 170, NACE.
Hinton, et al., The Corrosion Inhibition of Zinc with Cerous Chloride, Corrosion Science, 29, 1989, pp. 967-984.
Hinton, Corrosion Inhibition with Rare Earth Metal Salts, Journal of Alloys and Compounds, 180, 1992, pp. 15-25.
Fujita et al., "Fabrication of Co-Ce-O Films By Metal-Oxide Co-Electrodeposition Method From Reaction Solution Including A Complexing Agent", Nippon Oyo Jiki Gakkaishi (no month), 2001, vol. 25, No. 4-2, pp. 883-886.

* cited by examiner

CERIUM-BASED SPONTANEOUS COATING PROCESS FOR CORROSION PROTECTION OF ALUMINUM ALLOYS

This invention was made with government support under grant number AFOSRF49620-96-1-0140 awarded by the United States Air Force. The government has certain rights in the invention.

BACKGROUND OF THE INVENTION

This invention relates to a method for enhancing the corrosion resistance of aluminum and aluminum alloys by deposition of a cerium-based coating thereon. The invention has particular application for aerospace structural components such as aircraft skin, wing skin and other sheet components manufactured from aluminum or aluminum alloys, especially sheet and bulk structural pieces, or in other applications where long-term corrosion resistance is desired.

Many aerospace components are constructed from aluminum or aluminum alloys due to their superior strength to weight ratio. Aluminum and aluminum alloys, however, are subject to corrosion upon exposure to water condensed from humid air and contaminated from other sources with salt, rain, snow, ocean salt, salt applied to runways, and other environmental conditions, which can lead to catastrophic failure. Aluminum corrosion is an electrochemical process involving dissolution of metal at anodic sites according to the reaction $Al \rightarrow Al^{3+}$.

$+3e^-$. At cathodic sites the reduction of oxygen and evolution of hydrogen occur according to the reactions $O_2+2H_2O+4e^- \rightarrow 4OH^-$ and $2H^++2e^- \rightarrow H_2$. Corrosion inhibition is accomplished by reducing the rates at which these reactions occur.

Heretofore the corrosion resistance of aluminum and aluminum alloys has been enhanced by the use of chromate, conversion coatings. A conversion coating is a coating consisting of metallic salts, such as chromate, which form during and after dissolution of a metallic element, such as chromium or aluminum, or are precipitated from salts onto a substrate. A disadvantage of chromate coatings, however, is their toxicity, as ingestion or inhalation of chromates has been determined to cause kidney failure, liver damage, blood disorders, lung cancer and eventually death. Chromium is among the Environmental Protection Agency's leading toxic substances since in its hexavalent form it is a known carcinogen and is environmentally hazardous as a waste product. Many of the major environmental laws which are in force today unfavorably impact the use of chromate materials and processes. OSHA (Occupational Safety & Health Administration) requirements permit only 1 $\mu g/m^3$ of insoluble chromate in the air space per 10 hour day. The chromating processes generate large volumes of hazardous wastes. Due to the health risks and inevitable government legislation associated with the application of chromate materials and their disposal, there has been a worldwide research effort to develop alternative coatings which are technically equivalent but do not pose an environmental risk.

Corrosion resistance has also been enhanced by anodizing. However, anodizing is known to cause fatigue problems leading to failure of aluminum components.

The effectiveness of cerium salts (along with other rare-earth salts) as a potential replacement to chromates for aluminum alloys was first demonstrated in 1984 by Hinton et al. at the Aeronautical Research Laboratory of Australia. Hinton et al. found that after immersing an aluminum alloy in a solution containing cerium chloride for several days, a yellowish film was formed which provided significant corrosion protection for the alloy upon subsequent exposure to NaCl solution. Over the decade, cerium salts have attracted attention as an effective corrosion inhibitor because they are not toxic and are relatively inexpensive.

The degree of protection provided to the aluminum strongly depended on the time of immersion in the $CeCl_3$ solution. To achieve significant protection, an immersion time of at least 100 hours was generally required, which makes this process commercially unattractive. Further studies by Hinton et al. have shown that the cerium-containing films could be produced cathodically by polarizing an aluminum alloy specimen in 1000 ppm $CeCl_3$ aqueous solution for 30 minutes. However, this cathodic coating was inhomogeneous, had poor adhesion and provided much less protection than the film formed by immersion. Hinton attributed these problems to the presence of small holes formed in the coating by evolving hydrogen, which was overcome by electrodeposition from an organic butylcellosolve solution containing 10,000 ppm $Ce(NO_3)_3$. This cathodic film with a network of cracks exhibited a five-fold improvement in corrosion resistance over that of the uncoated alloy, but was inferior to those coatings formed by the immersion process.

The possibility of obtaining a suitable cerium dip coating more quickly by utilizing an oxidizing agent has been explored. Wilson and Hinton developed a patented process to produce Ce(IV) coatings using hydrogen peroxide. This technique involved a simple addition of 1~5% $H_2O_2$ into a solution of 10,000 ppm $CeCl_3$ at 50 C. A yellowish coating was readily formed on aluminum alloys between 2 and 10 minutes. The main advantage of this process was that it did not require a cathodic potential to form a coating in a reasonable time. The coating exhibits good adhesion to the substrate and to paint films. Regarding its corrosion protection, however, this coating did not perform as well as the films made by the long-term immersion process. Scanning electron microscope characterizations revealed the existence of heavily cracked regions which are considerably greater than the average thickness of the film.

Another dip process involving cerium compounds was developed by Mansfeld et al. Aluminum alloy coupons were first boiled in 10 mM $Ce(NO_3)3$ for 2 hours, then boiled in 5 mM $CeCl_3$ for another 2 hours. In the last step, an electrochemical treatment was applied by which the samples were polarized in deaerated 0.1 M $Na_2MoO_4$ at a potential of +500 mV vs. SCE for 2 hours. This process was successfully applied to the corrosion protection of aluminum alloy 6013-T6, which showed no signs of localized corrosion after 60 days' exposure to 0.5 M NaCl solution.

When this process was applied to aluminum alloys with higher alloy contents such as 7075-T6 and 2024-T3, less satisfactory results were obtained. Al 2024 alloys showed pitting after 1 day of exposure to the NaCl solution. Mansfeld et al. reported an improved process based on a pretreatment step. Prior to the cerium dip process, aluminum alloy 2024 or 7075 was polarized at −55 mV (vs. SCE) in a solution containing 0.5 M $NaNO_3$ acidified to a pH of 1 using HCl, or dip in an acidic chromate solution following a 20 vol % $HNO_3$ solution immersion for 1 minute. The modified process was reported to improve the pitting resistance of both 2024 and 7075 aluminum alloys.

SUMMARY OF THIS INVENTION

Among the several objects of this invention, therefore, is the enhancement of the corrosion resistance of aluminum and aluminum alloy aircraft components; the enhancement of the corrosion resistance of aluminum and aluminum alloys using materials which are not toxic in the relevant concentrations; the enhancement of the corrosion resistance of aluminum and aluminum alloys using a cerium-based coating produced by a spontaneous deposition process including, for example, dip, flow, intermittent flow, gel, intermittent dip, spray, and intermittent spray techniques resulting in spent electrolyte having minimal negative environmental impact.

Briefly, therefore, the invention is directed to a process for enhancing corrosion resistance of an aluminum-containing component comprising exposing the aluminum-containing component to a solution containing cerium ions to deposit a cerium-based coating thereon without applying an external source of electrons.

Other objects and features of the invention will be in part apparent, and in part described hereafter.

DETAILED DESCRIPTION OF THIS INVENTION

Cerium (Ce) is a malleable, ductile metallic element having an atomic number of 58 and an atomic weight of 140.12. It is the most abundant of the rare earth metallic elements. Cerium possesses stable oxides, $CeO_2$ or $Ce_2O_3$, in the oxidation states of 4 and 3. Cerium ions are precipitated to form an oxide adsorbed readily on the surface of $Al(OH)_3$ or $Al_2O_3$ to provide a Ce-based coating—an oxide or a salt, such as a phosphate after sealing—which provides extensive corrosion protection. A cerium-based coating is a coating formed by the precipitation of cerium salts onto a substrate. The preferred cerium-based coatings are cerium oxide, hydrated cerium oxide, or forms of cerium hydroxide. The cerium-based coating of the invention enhances corrosion resistance by enhanced barrier protection and electrochemical protection.

In accordance with the process of the invention, the cerium-based coatings of the invention are applied by a spontaneous process; i.e., a process involving exposure of the substrate to a cerium-containing electrolyte under certain conditions which are distinct from electrolytic conditions in that the spontaneous conditions do not involve an external source of electrons. The spontaneous processes of the invention include, but are not limited to, dip immersion, intermittent dip, gel application, spray application, and intermittent spray application. Further details of these application options are provided after the following general parameters applicable to all application embodiments.

Generally speaking, an aluminum-containing component is pretreated by cleaning and/or deoxidizing, thereafter exposed to a cerium-containing solution to deposit a cerium coating thereon without application of an external source of electrons, and finally optionally subjected to a sealing operation.

The cerium-based coating of the invention on an aluminum or aluminum alloy structural component is of relatively uniform thickness, is blister-free, and strongly adhered to the component. The coating has a continuous surface area of at least about 3 $in^2$, though it can be used on smaller areas, and a thickness of at least about 0.1 microns, preferably from about 0.1 to about 2.0 microns. In the spray application process of the invention, one preferred coating is about 1.5 microns thick. In the dip and gel application processes, one preferred coating is about 0.3 microns thick.

The pretreatment cleaning operation consists of rinsing the component with an organic solvent such as acetone followed by cleaning with a solution of an alkaline cleaner in water. In one preferred application, the alkaline cleaner is Turco alkaline cleaner distributed under the trade name Turco NCLT available from Henkel Surface Products, Madison Heights, Mich., in a concentration of 5% by weight in water. As a general proposition, the temperature of the cleaning solution is between about 25° C. and about 75° C. In one preferred embodiment, the component is immersed in this cleaning solution at between about 40° C. and about 65° C. for 5 to 15 minutes, and is then rinsed with distilled water. Another embodiment is carried out at between about 45° C. and about 75° C. In still another preferred embodiment, the component is immersed in this solution at between about 25° C. and about 65° C. for about 5 to about 10 minutes. The best results appear to be obtained when the precleaning is at about 55° C. Where immersion is not possible due to the size of the component, its being assembled onto an airplane, or otherwise, the cleaning solution is flowed over the surface. The component is then optionally rinsed with tap water followed by deionized water.

There is an optional surface pretreatment deoxidation and activation operation to provide a uniformly cleaned and deoxidized surface. In one embodiment this involves immersion in or exposure otherwise to 0.05 M sulfuric acid containing 0.02 M thiourea at ambient temperature for between about 5 and 15 minutes, preferably for about 10 minutes. The thiourea is used in some instances where the pretreatment overactivates the substrate.

In another embodiment the pretreatment deoxidation and activation operation involves immersion in or otherwise exposure to a solution comprising 5% to 15% by volume nitric or sulfuric acid and about 2.5 wt % Amchem #7, available from Amchem Products, Inc., a subsidiary of Henkel Surface Technologies, of Ambler, Pa., at ambient temperature for between about 5 and 15 minutes. In each instance, the substrate is subsequently rinsed, preferably with deionized water.

An electrolyte containing cerium is obtained by dissolving a cerium-containing compound in solution. In general, the cerium-containing compound is a cerium salt. A preferred electrolyte has an initial cerium ion concentration of from about 0.03 to 1 moles per liter cerium ions, more preferably from about 0.05 to about 0.19 moles per liter cerium ions, still more preferably from about 0.03 to 0.36 moles per liter cerium ions, and most preferably about 0.09 moles per liter cerium ions. In one preferred embodiment, the solution at a temperature of 10° C. to 35° C. contains between about 1 wt % and about 18 wt %, more preferably about 4 wt % $CeCl_3.7H_2O$.

The other components of the electrolyte, described more fully below, include distilled deionized water, hydrogen peroxide, an oxidizing salt, defoaming agents, surfactants, and gelatin. For example, one preferred bath contains 10 grams $CeCl_3.7H_2O$, 40 g $NaClO_4$,0.45 g of 30% concentrated $H_2O_2$, and from 0.1 wt % to about 0.5 wt % animal gelatin, defoaming agents, surfactants, and 200 ml water. Another preferred bath contains 0.16 M (4 wt %) or equivalent $CeCl_3.7H_2O$, 1.1 M (16 wt %) $NaClO_4$, 0.016 M (0.18 wt %) $H_2O_2$, plus other additives such as glycerol, ethylene glycol or other hydroxy compounds in an amount of about 3 wt % to 50 wt %, preferably about 15 wt %. Still another preferred electrolyte of about 250 mL is prepared with 10.0 g (93.7 mM) $CeCl_3.7H_2O$ in 195 mL deionized water, with enough nitric acid to adjust the pH to slightly below 2.0. To the solution is added 0.75 g animal gelatin or amino acid having been dissolved in 40 mL deionized water, bringing the pH to slightly above 2.0. To the overall solution is then added about 10 mL of 30% $H_2O_2$.

With regard to the specific components of the electrolyte, hydrogen peroxide is added to the electrolyte to facilitate formation of oxidized cerium during deposition. The $H_2O_2$ oxidizes the Ce to its +4 state. Hydrogen peroxide is preferably added to the solution after the introduction of the cerium salt, animal gelatin, and suitable acid to give the desired pH, and optionally sodium perchlorate. The preferred initial $H_2O_2$ concentration is between about 0.05 wt % and about 8.0 wt %, more preferably between about 0.10 wt % and about 4.0 wt %. As an alternative to $H_2O_2$, another suitable depolarizing or oxidizing agent such as ozone, nitric acid, or the like may be used. to $H_2O_2$, another suitable depolarizing or oxidizing agent such as ozone, nitric acid, or the like may be used.

In early testing it appears that the hydrogen peroxide beneficially changes the pH at which the Ce will deposit under preferred conditions. In particular, the hydrogen peroxide is believed to in part decompose to provide hydrogen, which in turns combines with oxygen to provide an hydroxide source, thereby reducing the need for another hydroxide source in the solution. Hydroxide is needed as a driver for Ce deposition as the first Ce species to form is believed to be Ce hydroxide. Accordingly, as the need to provide an external source of hydroxide is reduced, the pH can be kept more relatively acidic so the Ce salt is less likely to prematurely precipitate out on the bottom of the coating vessel or otherwise not on the substrate as intended.

The solution also preferably contains at least one oxidizing salt such as perchlorate or chlorate in order to impart more uniform cerium film growth. The perchlorate or the like helps to maintain the oxidation potential sufficiently high to stabilize the Ce in its +4 oxidation state. One preferred perchlorate is $NaClO_4.H_2O$, with a preferred initial concentration between about 5 wt % and about 30 wt %, more preferably between about 10 wt % and about 20 wt %. In one preferred embodiment the $NaClO_4.H_2O$ concentration is about 16 wt %.

The bath optionally contains animal gelatin, glycerol, or other organic additive to improve coating uniformity and corrosion resistance. The amount of gelatin added to the bath in one preferred embodiment is between about 0.1 wt % and about 2.0 wt %, preferably between about 0.1 wt % and about 1.0 wt %, more preferably between about 0.2 wt % and about 0.35 wt %. One preferred animal gelatin is SKW acid processed pigskin available from SKW Biosystems of Waukesha, Wis. Without being bound to a particular theory, it is thought that the gelatin functions to modify the nucleation and growth sites.

Especially good results appear to be obtained in one particular embodiment when a polyhydroxide compound is incorporated in an amount between about 1 and about 75 wt %, preferably between about 10 and about 30 wt %, especially about 15 wt %. In one embodiment this polyhdroxide compound is preferably glycerol. The polyhydroxide compound or glycerol is thought to slow hydrogen bubbling and therefore temper pH change at the substrate surface, thereby helping to maintain hydroxide concentration at the deposition site. Inasmuch as the initial Ce species deposited is believed to be an hydroxide species, this perceived effect of the glycerol is consistent with the need to accumulate hydroxide in a substrate surface layer to promote deposition.

The initial bulk pH of the electrolytic is preferably from about 1.0 to about 5.0, more preferably from 2.1 to about 4.5. It has been discovered that if the local pH at the interface between the cathode and electrolyte is too acidic, the cerium-based compound to be precipitated onto the substrate remains soluble, and does not precipitate, and in fact never deposits to an acceptable degree or in an acceptable morphology. If the local pH is not sufficiently acidic, any deposit which forms has an improper composition and structure. As such, the bulk pH is maintained at a level which promotes the proper local pH at this interface.

Surfactants are optionally added to the bath in an amount between about 0.05 wt % and about 1 wt %, preferably between about 0.1 wt % and about 0.5 wt %, more preferably between about 0.15 wt % and about 0.2 wt %.

The component to be coated functions by providing anodic sites, although no external source of electrons is provided. The component may be pure aluminum or an aluminum alloy having 85% or more aluminum by weight, such as alloys in the 2000, 3000, 6000, and 7000 series generally, and alloys 7075 aluminum, 2024 aluminum, and 3003 aluminum specifically.

It is believed that the cerium ions in the vicinity of the aluminum cathode can be oxidized from $3^+$ to $4^+$ and with an increase in pH as hydrogen evolves, can precipitate as cerium (Ce IV) species. In contrast to electrolytic processes with an external source of electrons, in this spontaneous process the acidic halide media attacks the aluminum substrate surface forming local anodes as the driving force to evolve hydrogen at the local cathodes.

The temperature of the electrolyte is preferably in the range of between about 10° C. and about 35° C. If the temperature is too high, the chemical composition of the solution changes. If the temperature is too low, the reaction kinetics are too slow.

Once the desired thickness is deposited, the component is removed from exposure to the electrolyte. The thickness of the coating deposited is typically on the order of about 0.1 microns to about 2 microns.

After deposition the component is optionally sealed by immersion in or otherwise exposure to an elevated temperature phosphate solution, for example 2.5 wt % $Na_3PO_4$ with a pH adjusted to about 4.5 with $H_3PO_4$ for about five minutes. In one especially preferred embodiment where it has been discovered to be critical that the phosphate solution be non-boiling, the sealing solution is maintained at a temperature between 70° C. and about 95° C. Sealing involves expansion of the lattice of the deposited material such that it essentially grows together. The coating yielded is substantially continuous, i.e., the instance of cracking and other discontinuity is relatively low. Without being bound to a particular theory, it is believed that cerium phosphate compounds are formed.

Turning now to the specific modes of deposition in accordance with this invention, a first mode involves dip immersion of the component in the cerium-containing electrolyte. The component to be treated is immersed in the dip coating solution for up to about 40 minutes, preferably for between about 1 and about 20 minutes. In one preferred process, the immersion time is between about 1 and about 20 minutes, preferably between about 5 and about 15 minutes. The dip solution is optionally agitated physically by use of ultrasound, magnetic stirring, forced convection, or barrel coating.

Another application mode of the invention is an intermittent dip process whereby the substrate is immersed in the electrolyte for a period of time, removed, and re-immersed, with the process repeated between two and several (e.g., about 10) times. There is an optional deionized water rinse between immersions, but indications are that results are better without rinsing. Between immersions there is preferably a delay of, for example, from about 15 seconds to about 90 seconds, with on the order of 30 to 40 seconds of delay being preferred for one embodiment. The actual immersion time per cycle in one embodiment involving a substrate with a surface area on one side of, for example, four square inches is from on the order of about 15 seconds to on the order of about 20 seconds. The overall time of intermittent dipping and delay is from on the order of 5 minutes to on the order of 20 minutes, with between about 10 and about 15 minutes, especially 10 minutes, being preferred for one embodiment. The intermittent aspects of this embodiment advantageously facilitate removal of bubbles formed during coating and generation of the proper pH for precipitation. In particular, bubbles tend to form on the substrate surface, which can interfere with coating and uniformity of the chemical environment. By removing the substrate intermittently from the electrolyte, this interference is minimized, and the driving force for further deposition is renewed.

Alternative flow and intermittent flow processes involve flowing the electrolyte over the surface to be treated. As opposed to the dip process, this flow process and the other alternative applications methods described herein are more readily adaptable to mobile application, as at airports, temporary military landing strips, aircraft carriers, and the like. They are performed without immersion, i.e., without dipping the component completely into a vessel containing the treatment solution. This has potential advantage based on early observations that the cerium in the solution cannot migrate away from the component surface, as it can when there is a vessel of liquid surrounding the component as in dip immersion processes. These alternative processes are suitable for touch up repair of aluminum components in active service. They permit application of the electrolyte to a substrate without disassembly of the substrate from, for example, an overall aircraft. As such, portions of an aircraft needing a corrosion prevention treatment can be treated on site and without disassembly and immersion in a vessel. Specific locations can be targeted.

In the flow process, in particular, the electrolyte is flowed over the substrate at a rate of, for example, about 15 to about 50 mL per minute. In one preferred embodiment the flow rate is about 20 to about 40 mL per minute, especially about 25 mL per minute for an area of about 4 $in^2$.

In the flow process, electrolyte is delivered to the substrate from a distance of about 5 to about 18 inches. In one preferred embodiment, the delivery distance is from about 7 to about 12 inches, especially about 10 inches.

The intermittent flow process involves flow of electrolyte over the substrate for a period of time, and reflowing, with the process repeated between two and several (e.g., about 10) times. Between flowing and re-flowing steps there is preferably a delay of, for example, from about 15 seconds to about 90 seconds, with on the order of 30 to 40 seconds of delay being preferred for one embodiment. The actual flow time per cycle in one embodiment involving a substrate with a surface area on one side of four square inches is from on the order of about 15 seconds to on the order of about 20 seconds. The overall time of intermittent flow and delay is from on the order of 5 minutes to on the order of 20 minutes, with between about 10 and about 15 minutes, especially 10 minutes, being preferred for one embodiment. The intermittent aspects of this embodiment advantageously facilitate removal of bubbles formed during coating, and generation of the desired pH, as described in further detail above in the context of the intermittent dip process.

In a further alternative spray process, the electrolyte is applied in the form of a spray administered to the workpiece from a delivery distance of between about 3 and about 12 inches, with the distance being between about 5 and about 10 inches, preferably about 8 inches, in one embodiment. There is also an intermittent spray process involving sequential and repeated operations of exposure, rinse, and delay. The other parameters of exposure time, rinsing, and the like for the spray process are generally the same as described above for the dip and flow processes. The differences between the flow and spray processes are primarily the physical characteristics of electrolyte: a flow stream versus a fine spray.

One aspect of the spray process which appears to have materialized in early testing is that the benefits of the perchlorate or other oxidizing salt additions do not manifest themselves, or at least not as much, as they do with the other application methods. Similarly, the benefits of glycerol additions do not appear to manifest themselves in early testing of the spray processes, or at least not as much as they do with the other application methods. As such, it appears these components are not necessary in the spray process.

In each of the above processes, the evolution of hydrogen and removal of bubbles by movements during the successive application, removal, rinse, and rest steps assist in maintaining the necessary interfacial pH and thereby maintaining a fresh driving force for deposition.

The temperature of the substrate is maintained in the range of about 10° C. to about 40° C., as too high a temperature can result in poor adhesion.

A still further application method for the spontaneous cerium coating of the invention involves application of a cerium-containing gel. The gel is prepared by adding a thickener directly to a cerium containing electrolyte prepared as in accordance with the description above. In one preferred embodiment, the thickener hydroxyethylcellulose is added directly to an electrolyte of perchlorate (16 wt %), cerium chloride (4 wt %), hydrogen peroxide (0.18 to 0.5 wt % of a 30% $H_2O_2$ solution), and distilled and deionized water (80 wt %) at ambient temperature. The cellulose material is allowed to swell prior to application, and the gel can be used for at least a week, for example.

The gel is alternatively prepared by dissolving about 1.2 to 2.0 wt % of hydroxyethlycellulose into distilled and deionized water by heating the gel/water to about 35° C.–45° C. until all the cellulose material is in solution, producing a more viscous gel. This gel/water solution is then combined with about 50 wt % to about 65 wt %, for example, of the cerium containing electrolyte as described above.

It has been discovered that the gel coating deposition rate is related to peroxide concentration, with the preferred peroxide concentration being from about 0.18 wt % to about 0.27 wt %, preferably about 0.2 wt %, of a 30% peroxide solution.

The cerium containing gel is swabbed or similarly applied directly onto the substrate to be treated. The gel is initially colorless, but the portion in contact with the metal surface turns orange after about 40 to 60 seconds exposure time, indicating the formation of cerium precipitates. Outer layers of the gel remain colorless, and therefore unreacted. The gel is removed by rinsing after about 60 to 120 seconds of exposure. The unreacted gel can be re-applied; and in general there are optionally multiple applications as with the dip, flow, and spray processes.

The foregoing relates only to a limited number of embodiments that have been provided for illustration purposes only. It is intended that the scope of invention is defined by the appended claims and there are modifications of the above embodiments that do not depart from the scope of the invention.

What is claimed is:

1. A process for enhancing corrosion resistance of an aluminum-based component comprising:

exposing the aluminum-based component to a cleaning solution in water to yield a cleaned aluminum-based component;

exposing the cleaned aluminum-based component to corrosion-inhibiting cerium solution containing a cerium ions in the presence of an oxidizing agent and without applying an external source of electrons to thereby deposit a cerium-based coating onto the cleaned aluminum-based component; and sealing the cerium-based coating by exposure to an elevated temperature phosphate solution to yield a substantially continuous coating thereon.

2. The process of claim 1 wherein the elevated temperature phosphate solution is non-boiling and is at a temperature between about 70° C. and about 95° C.

3. The process of claim 2 wherein the cleaning solution is an alkaline cleaner solution in water at a temperature of between about 25° C. and about 75° C.

4. The process of claim 1 wherein the oxidizing agent comprises hydrogen peroxide in a concentration of between about 0.05 wt % and about 8.0 wt % of the cerium solution, and wherein the cerium ions have a concentration of between about 0.03 moles per liter and about 1.0 mole per liter of the cerium solution.

5. The process of claim 1 wherein the cerium solution further comprises glycerol.

6. The process of claim 5 wherein the cerium solution comprises between about 10 wt % and about 30 wt % glycerol.

7. The process of claim 1 wherein the cerium solution comprises between about 10 wt % and about 30 wt % of one or more polyhydroxide compounds.

8. The process of claim 1 wherein the cerium solution comprises animal gelatin.

9. The process of claim 8 wherein the animal gelatin constitutes between about 0.1 wt % and about 1.0 wt % of the cerium solution.

10. The process of claim 1 wherein the cerium solution comprises amino acid.

11. The process of claim 1 wherein the cerium solution comprises processed pigskin as an animal gelatin additive.

12. The process of claim 11 wherein the processed pigskin comprises between about 0.1 wt % and about 1.0 wt % of the cerium solution.

13. The process of claim 1 wherein the cerium solution contains an oxidizing compound.

14. The process of claim 13 wherein the oxidizing compound is an oxidizing salt selected from among chlorate and perchlorate compounds.

15. The process of claim 13 wherein the oxidizing compound is $NaClO_4.H_2O$ in a concentration of between about 5 wt % and about 30 wt % of the cerium solution.

16. The process of claim 1 wherein exposing the cleaned aluminum-based component to corrosion-inhibiting cerium solution comprises exposing the cleaned aluminum-based component to said cerium ion solution containing cerium ions in a concentration of between about 0.03 and about 1.0 mole per liter, hydrogen peroxide in a concentration of between about 0.05 wt % and about 8.0 wt % of the cerium solution, glycerol in a concentration of between about 10 wt % and about 30 wt % of the cerium solution, and a perchlorate compound oxidizing salt in a concentration of between about 5 wt % and about 30 wt % of the cerium solution.

17. The process of claim 1 wherein exposing the cleaned aluminum-based component to corrosion-inhibiting cerium solution comprises exposing the cleaned aluminum-based component to said cerium ion solution having a pH between about 2.1 and about 4.5 and containing cerium ions in a concentration of between about 0.03 and about 1.0 mole per liter, hydrogen peroxide in a concentration of between about 0.05 wt % and about 0.35 wt % of the cerium solution, glycerol in a concentration of between about 10 wt % and about 30 wt % of the cerium solution, and a perchlorate compound oxidizing salt in a concentration of between about 5 wt % and about 30 wt % of the cerium solution; and wherein sealing the cerium-based coating by exposure to an elevated temperature phosphate solution comprises exposure to a phosphate solution which is non-boiling and is at a temperature between about 70° C. and about 95° C.

18. The process of claim 17 wherein the cerium ion solution further contains a component select from among animal gelatin and amino acids.

19. The process of claim 1 wherein exposing the aluminum-based component to the cerium solution comprises immersing the component in said solution.

20. The process of claim 1 wherein exposing the aluminum-based component to the cerium solution comprises flowing the solution over the component.

21. The process of claim 1 wherein exposing the aluminum-based component to the solution comprises spraying the solution onto the component.

22. The process of claim 1 wherein exposing the aluminum-based component to the solution comprises applying a gel containing the solution onto the component.

23. A process for enhancing corrosion resistance of an aluminum-containing component comprising:

exposing the component to a water-based alkaline cleaning solution for between about 5 and about 15 minutes;

rinsing the component;

exposing the component to a solution containing an oxidizing salt, a cerium salt, glycerol, and hydrogen peroxide for between about 1 and about 20 minutes to deposit a cerium-based coating thereon without applying an external source of electrons;

immersing the component in an elevated temperature non-boiling phosphate solution to seal the cerium-based coating; and rinsing the component.

24. The process of claim 23 further comprising immersing the component in a deoxidizing solution at about ambient temperature comprising an acid for between about 5 and about 15 minutes after removing the component from the water-based alkaline cleaning solution and before immersing the component in the solution containing the cerium salt.

25. A process for enhancing corrosion resistance of an aluminum-based component comprising:

flowing a corrosion-inhibiting cerium solution containing cerium ions in the presence of an oxidizing agent over the aluminum-based component without complete immersion of the component in the solution and without applying an external source of electrons, to thereby deposit a cerium-based coating onto the aluminum-based component.

26. The process of claim 25 comprising sealing the cerium-based coating by exposure to an elevated temperature phosphate solution to yield a substantially continuous coating.

27. The process of claim 26 wherein the elevated temperature phosphate solution is non-boiling and at a temperature in the range of about 70° C. to about 95° C.

28. The process of claim 25 comprising exposing the aluminum-based component to an alkaline cleaner solution in water prior to said flowing to yield a cleaned aluminum-based component;

said flowing of said corrosion-inhibiting cerium solution containing cerium ions in the presence of an oxidizing agent over the aluminum-based component without complete immersion of the component in the solution and without applying an external source of electrons, to thereby deposit said cerium-based coating onto the aluminum-based component; and sealing the cerium-based coating by exposure to an elevated temperature phosphate solution to yield a substantially continuous coating thereon.

29. The process of claim 25 comprising terminating the flowing followed by repeating said flowing.

30. The process of claim 29 wherein there is a delay of at least about 15 seconds between said terminating and said repeating said flowing.

31. The process of claim 25 comprising:

exposing the aluminum-based component to an alkaline cleaner solution in water prior to said flowing to yield a cleaned aluminum-based component;

said flowing of said corrosion-inhibiting cerium solution containing cerium ions in the presence of an oxidizing agent over the aluminum-based component without complete immersion of the component in the solution and without applying an external source of electrons, to thereby deposit said cerium-based coating onto the aluminum-based component;

terminating said flowing;

repeating said flowing; and sealing the cerium-based coating by exposure to an elevated temperature phosphate solution to yield a substantially continuous coating thereon.

32. The process of claim 31 wherein the elevated temperature phosphate solution is non-boiling and at a temperature between about 75° C. and about 90° C.

33. A process for enhancing corrosion resistance of an aluminum-based component comprising:

spraying a corrosion-inhibiting cerium solution containing cerium ions in the presence of an oxidizing agent over the aluminum-based component without complete immersion of the component in the solution and without applying an external source of electrons, to thereby deposit a cerium-based coating onto the aluminum-based component.

34. The process of claim 33 comprising sealing the cerium-based coating by exposure to an elevated temperature phosphate solution to yield a substantially continuous coating.

35. The process of claim 34 wherein the elevated temperature phosphate solution is non-boiling and at a temperature in the range of about 70° C. to about 95° C.

36. The process of claim 33 comprising exposing the aluminum-based component to an alkaline cleaner solution in water prior to said flowing to yield a cleaned aluminum-based component;

said spraying of said corrosion-inhibiting cerium solution containing cerium ions in the presence of an oxidizing agent over the aluminum-based component without complete immersion of the component in the solution and without applying an external source of electrons, to thereby deposit said cerium-based coating onto the aluminum-based component; and sealing the cerium-based coating by exposure to an elevated temperature phosphate solution to yield a substantially continuous coating thereon.

37. The process of claim 33 comprising terminating said spraying followed by repeating said spraying.

38. The process of claim 37 wherein there is a delay of at least about 15 seconds between said terminating and said repeating said spraying.

39. The process of claim 33 comprising:

exposing the aluminum-based component to an alkaline cleaner solution in water prior to said flowing to yield a cleaned aluminum-based component;

said spraying of said corrosion-inhibiting cerium solution containing cerium ions in the presence of an oxidizing agent over the aluminum-based component without complete immersion of the component in the solution and without applying an external source of electrons, to thereby deposit said cerium-based coating onto the aluminum-based component;

terminating said spraying;

repeating said spraying; and sealing the cerium-based coating by exposure to an elevated temperature phosphate solution to yield a substantially continuous coating.

40. The process of claim 39 wherein the elevated temperature phosphate solution is non-boiling and at a temperature between about 75° C. and about 90° C.

41. A process for enhancing corrosion resistance of an aluminum-based component comprising:

applying a gel comprising a corrosion-inhibiting cerium solution containing cerium ions in the presence of an oxidizing agent to the aluminum-based component, to thereby deposit a cerium-based coating onto the aluminum-based component.

42. The process of claim 41 comprising:

exposing the aluminum-based component to an alkaline cleaner solution in water prior to said spraying to yield a cleaned aluminum-based component;

said applying said gel containing said corrosion-inhibiting cerium solution containing cerium ions to the aluminum-based component, to thereby deposit said cerium-based coating onto the aluminum-based component; and sealing the cerium-based coating by exposure to an elevated temperature phosphate solution to yield a substantially continuous coating thereon.

43. The process of claim 42 wherein the elevated temperature phosphate solution is non-boiling and at a temperature in the range of about 70° C. to about 95° C.

44. The process of claim 41 comprising sealing the cerium-based coating by exposure to an elevated temperature phosphate solution to yield a substantially continuous coating.

45. The process of claim 44 wherein the elevated temperature phosphate solution is non-boiling and at a temperature in the range of about 70° C. to about 95° C.

46. The process of claim 41 wherein the gel comprises hydroxyethylcellulose.

47. A process for enhancing corrosion resistance of an aluminum-based component comprising:

immersing the aluminum-based component in a corrosion-inhibiting cerium solution containing cerium ions in the presence of an oxidizing agent without applying an external source of electrons, to thereby deposit said cerium-based coating onto the aluminum-based component;

removing the aluminum-based component from the cerium solution;

repeating said immersing and said removing until said coating achieves a desired thickness.

48. The process of claim 47 comprising:

sealing the cerium-based coating by exposure to an elevated temperature phosphate solution to yield a substantially continuous coating thereon.

49. The process of claim 48 wherein the elevated temperature phosphate solution is non-boiling and at a temperature in the range of about 75° C. to about 90° C.

50. The process of claim 49 further comprising exposing the aluminum-based component to an alkaline cleaner solution in water prior to said immersing.

51. The process of claim 47 wherein said immersing and said removing is repeated between two and about ten times.

52. The process of claim 47 further comprising:

rinsing the aluminum-based component with deionized water before repeating said immersing and said removing of the aluminum-based component.

53. The process of claim 47 further comprising a delay from about 15 seconds to about 90 seconds after removing the aluminum-based component from the cerium solution and before repeating said immersing and said removing of the aluminum-based component.

54. The process of claim 47 wherein said immersing is from on the order of about 15 seconds to on the order of about 20 seconds.

55. The process of claim 47 having an overall process time from on the order of 5 minutes to on the order of 20 minutes.

* * * * *